US006523190B1

(12) United States Patent
Bartlett

(10) Patent No.: US 6,523,190 B1
(45) Date of Patent: Feb. 25, 2003

(54) HEAT RETAINING SWIMMING POOL COVER

(75) Inventor: Chris Bartlett, Missisauga (CA)

(73) Assignee: Cantar/Polyair Corporation, Youngstown, OH (US)

( * ) Notice: Subject to any disclaimer, the term of this patent is extended or adjusted under 35 U.S.C. 154(b) by 0 days.

(21) Appl. No.: 10/058,037

(22) Filed: Jan. 29, 2002

(51) Int. Cl.[7] ..... E04H 4/00
(52) U.S. Cl. ..... 4/498; 4/499
(58) Field of Search ..... 4/498, 499

(56) References Cited

U.S. PATENT DOCUMENTS 3,072,920 A * 1/1963 Yellott ..... 4/498
4,028,750 A * 6/1977 Gustafsson ..... 4/498
4,426,995 A * 1/1984 Wilson ..... 4/498
6,286,155 B1 9/2001 Handwerker ..... 4/498
6,317,902 B2 11/2001 Handwerker ..... 4/498

* cited by examiner

*Primary Examiner*—Gregory Huson
*Assistant Examiner*—Tuan Nguyen
(74) *Attorney, Agent, or Firm*—Birch, Stewart, Kolasch & Birch, LLP

(57) ABSTRACT

A heat retaining swimming pool cover (1) is floatable on pool water (2) in a swimming pool (3) and has a plastic upper film (5) for facing toward the atmosphere (6), a plastic lower film (8) for facing toward the pool water (2), sufficient spaced apart air pockets (10) configured into the lower film (8) for containing air such that the cover (1) is floatable on the pool water (2), and sealed land areas (11) between the air pockets (10) such that the upper and lower films (5,8) are sealed to each other. The lower film (8) contains an infrared absorbent effective amount of an infrared absorbent but which amount is insufficient to prevent sunlight (14) from substantially penetrating the lower film (8) and passing into the pool water (2).

15 Claims, 1 Drawing Sheet

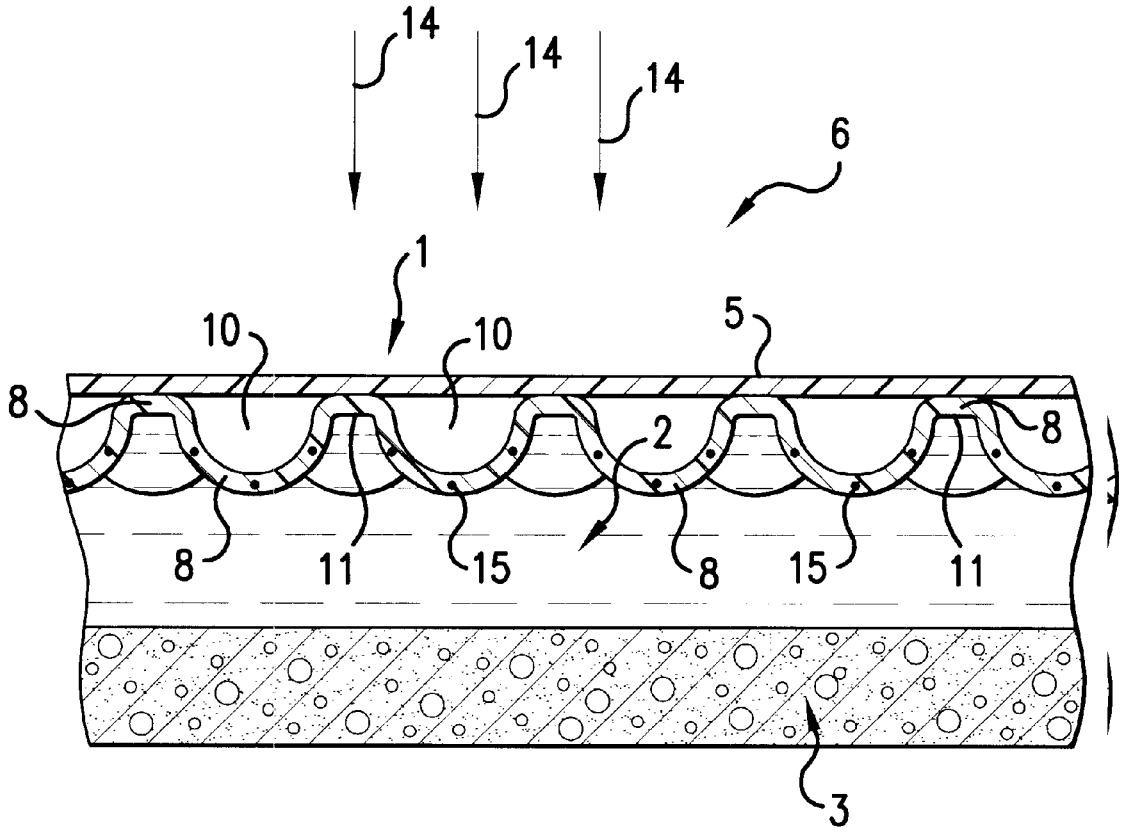
14
14
14
6
1
10
10
5
8
8
2
8
11
15
8
15
11
3

HEAT RETAINING SWIMMING POOL COVER

The present invention relates to a heat retaining swimming pool cover, and especially to such a pool cover which can be floatably disposed on pool water in a swimming pool. More particularly, the invention relates to such swimming pool cover which can significantly increase the temperature of pool water in the swimming pool by absorption and retention of heat from sunlight.

BACKGROUND OF THE INVENTION

The temperature of pool water in a swimming pool, especially an outdoor swimming pool, can significantly change over the course of a 24 hour period. During the day, especially on bright sunny days, sunlight from the atmosphere enters into and is absorbed by the pool water, which absorption generates sensible heat in the pool water. The efficiency of absorption and retention of that heat is not, however, very great. In one aspect, the walls of a pool are normally light in color and that light color reflects the sunlight back out of the pool before absorption occurs. The absorption of the sunlight could be much improved if the pool walls were painted a dark color, e.g. black, but this is not only unattractive, but is illegal in some jurisdictions, since the dark color makes it difficult to identify objects (or persons) under the pool water.

In another aspect, heat is lost from the pool water by re-radiation from the pool water to the atmosphere. In yet another aspect, particularly during the dark or night hours when the atmospheric temperature tends to drop, heat is lost by conduction from the pool water surface to the surrounding atmosphere. In this latter regard, it has been quite popular to provide pools with a pool cover that floats on the pool water. This cover, essentially, covers the entire surface of the pool water and is an insulator for reducing the amount of heat transferred from the surface of the pool water to the atmosphere, especially during the dark or night hours. Since the cover is floatable on the pool water, the cover can be easily removed during the day when required for swimming purposes, and replaced on the pool water after swimming or in the evenings for heat retention purposes.

These floatable pool covers, generally, have a plastic upper layer or film for facing toward the atmosphere, a plastic lower layer or film for facing toward the pool water, and a sufficient number of spaced apart air pockets configured into the lower layer or film such that the cover is floatable on the pool water. Land areas between the air pockets are sealed, such that the upper and lower layers or films are sealed to each other and the air pockets are, therefore, watertight. The air pockets in the cover provide floatibality to the cover and insulation to reduce the amount of heat transferred by conduction from the pool water to the atmosphere, especially during the dark or night hours. These conventional covers are made of, generally, transparent plastic film in which an air pocket has been configured into a lower layer of the film by molding, embossing and the like. The air pockets may be of any desired shape, e.g. hemispherical, square, rectangular, triangular, etc. Usually, these conventional covers will have a very small amount of a tint material in the plastic films forming the cover for cosmetic purposes. Since a very light blue color is generally associated with clean pool water, a very low intensity blue tint is normally placed in the plastic films for that cosmetic purpose.

However, the tints, as well as the pool cover itself, do not essentially affect passage of sunlight through the pool cover into the pool water during the day or radiation from the pool and pool water to the atmosphere during the dark or night hours. As a result, while the cover can allow the pool water to rise in temperature during the day, by transmission of sunlight into the pool water, substantial amounts of the heat absorbed by the pool water are re-radiated to the atmosphere, especially during the night or dark hours, and the temperature of the pool water considerably drops, even though some heat retention is provided by the insulation properties of the pool covers.

In view of the foregoing, the art has made efforts to improve these conventional floatable pool covers, such that the pool water, overall, retains a greater amount of heat. For example, U.S. Pat. Nos. 6,286,155 B1 and 6,317,902 B2, disclose such a floatable pool cover where an upper layer of the cover has a dark color and a lower layer has a light reflective material applied to one of the surfaces thereof. It is said that the dark color of the upper layer acts to draw heat into the pool, presumably by absorption and conduction, and the lower reflective layer reflects heat radiated from the pool water back into the pool water. The reflective material of the lower layer is a silver-colored commercially available master batch material containing an aluminum concentrate.

However, with this arrangement the reflective lower layer not only reflects radiant heat from the pool water back into the pool water, but also reflects sunlight from the atmosphere back into the atmosphere. Thus, while absorbed heat in the pool water is conserved by that lower layer reflectance, that lower layer reflectance decreases the total heat absorbed by the pool water by an amount proportional to the amount of atmospheric sunlight reflected from that lower layer back into the atmosphere. In addition, the dark color of the upper layer significantly decreases the transmission of sunlight through that upper layer and into the pool water. Thus, while the reflective lower layer of those patents is effective in reflecting heat from the pool water back into the pool water, hence conserving heat in the pool water, that lower layer very undesirably also reflects sunlight from the atmosphere back into the atmosphere, which significantly decreases the amount of sunlight reaching the pool water for heating purposes. In other words, something of a compromise is reached in the arrangement of having a reflective lower layer, and the compromise entails a decrease in the amount of sunlight passing through the pool cover into the pool water for heating thereof. Further, in order for the lower layer to be effective, the lower layer must be substantially reflective. Thus, the amount of reflective material associated with that lower layer also makes that lower layer substantially non-transparent and can be a safety problem for the reason mentioned above.

It would, of course, be an advantage to the art to provide a heat retaining pool cover which does not substantially interfere with sunlight passing through the cover and into the pool water for heating thereof. Also, it would be an advantage to provide a pool cover where the air pockets of the cover are specifically heated so that heat can be transferred by conduction from the pool cover to the pool water. With both of these means of heat transfer to the pool water, significant amounts of heat can be generated in and retained by the pool water both during the day and during the dark or night hours.

SUMMARY OF THE INVENTION

The invention is based on several primary and subsidiary discoveries.

First of all, it was recognized that the reflective lower layer of the above-noted patents is something of a compromise, as explained above. Thus, as a primary discovery, it was found that the reflective layer must be eliminated, but, in addition, a substitute therefore was required. Otherwise, just eliminating the reflectivity of the lower layer would result, essentially, in a conventional pool cover with a dark upper layer and such a cover would not be significantly effective.

As a second primary discovery, it was found that instead of providing the lower film with reflective properties, very substantial advantages could be obtained by providing the lower film with infrared absorbing properties. Those infrared absorbing properties are providing by including in or on the lower film an infrared (I.R.) absorbent.

However, as a subsidiary discovery, it was found that the amount of the I.R. absorbent must be controlled. If the amount it too great, then most of the heat value of the sunlight, i.e. in the I.R. spectrum, is absorbed by the cover and does not pass directly into the pool. This would be a disadvantage.

Therefore, as another primary discovery, it was found that the lower film should contain an I.R. absorbent effective amount of an I.R. absorbent, but which amount is insufficient to prevent atmospheric sunlight from substantially penetrating the lower film and passing into the pool water.

Such an amount of the I.R. absorbent will allow substantial I.R. radiation to pass through the cover and into the pool water to heat the pool water during the daytime period. However, some of the sunlight is absorbed by the infrared absorbent and is turned into heat in the lower film of the cover. That heat transfers from the lower film to the pool water by way of conduction with the pool water next to the lower film of the pool cover. Further, heat radiated from the pool water and pool walls will be absorbed by the I.R. absorbent in the lower film and rendered into sensible heat which also heats the pool water next to the pool cover. In addition, that absorption of infrared in the lower film heats the air in the air pockets of the pool cover, as well as air trapped between the cover and the surface of the pool water (mainly dispersed between air pockets). The trapped air is also heated directly by sunlight passing through the cover. That heated air, both the air in the pockets and the trapped air, transfers heat to the pool water, as noted above, and also forms an insulator to prevent conduction of heat from the pool water to the atmosphere.

Thus, as a basic principle of the invention, the lower film of the present floatable film cover contains an I.R. absorbent in specific amounts as described above.

Accordingly, briefly stated, the invention provides a heat retaining pool cover for floating disposition on pool water in a swimming pool. The cover comprises a plastic upper film for facing toward the atmosphere, a plastic lower film for facing toward the pool water, sufficient spaced apart air pockets configured into the lower film for containing air such that the cover is floatable on the pool water, sealed land area between the air pockets such that the upper and lower films are sealed to each other, and wherein the lower film contains an I.R. absorbent effective amount of an I.R. absorbent, but which amount is insufficient to prevent atmospheric sunlight from substantially penetrating the lower film and passing into the pool water. With this arrangement, almost all of the atmospheric sunlight, including the infrared, is either passed by radiation into the pool water for heating thereof or absorbed by the lower film for heating the pool water by conduction, and essentially none of the sunlight is reflected back to the atmosphere, as is the case in the above-described patents.

BRIEF DESCRIPTION OF THE DRAWINGS

The FIGURE is a cross-sectional view of the pool cover of the present invention.

DESCRIPTION OF EMBODIMENTS

As can be seen from the FIGURE, the pool cover, generally 1, floats on pool water, generally 2, contained within a swimming pool, generally 3. The pool cover 1 has a plastic upper film 5 for facing toward the atmosphere, generally 6. The cover also has a plastic lower film 8 for facing toward the pool water 2. Air pockets 10 are sufficiently spaced apart and are configured into lower film 8 for containing air such that the cover 1 is floatable on the pool water 2. The cover has sealed land areas 11 between the air pockets 10 such that the upper and lower films 5 and 8 are sealed to each other. Lower film 8 contains an I.R. absorbent effective amount of an I.R. absorbent, but which amount is insufficient to prevent atmospheric sunlight, generally 14, from passing into pool water 2.

The upper and lower films 5 and 8 are made of essentially transparent plastic films, such as vinyl or olefin, e. g. polyethylene and polypropylene, or acetate films. However, as noted above and is conventional, these films will normally have a small amount of a tint therein, but that amount is only sufficient for cosmetic purposes and will not significantly reduce the transmission of sunlight. The tint is generally a very light blue tent, for the reasons explained above. This is very conventional in the art and will not be described in more detail herein for purposes of conciseness.

While the I.R. absorbent can be any of the conventional liquid or solid I.R. absorbents, it is preferable that the I.R. absorbent is a solid particulate absorbent, as indicated in the figure by numeral 15. The drawing only shows a few particles of the solid absorbent for illustration purposes, but in reality, the very small particulate I.R. absorbent is widely and uniformly dispersed in or on lower film 8. It is important that the solid particulate I.R. absorbent is substantially non-reflective for the reasons explained above, i.e., briefly, it is not desirable for the sunlight 14 to be reflected back to the atmosphere 6 by reflective material in lower film 8. The solid particulate I.R. absorbent can be a variety of mineral-type I.R. absorbents, or even carbon or carbon black, and the I.R. absorbent may be in a carrier which can be useful for incorporating the I.R. absorbent into lower film 8 when that film is extruded during the manufacture. In any event, whichever I.R. absorbent is used in lower film 8, the amount of absorbent in lower film 8 should be, as described above, insufficient to prevent substantial penetration of sunlight and, generally, for solid particulate absorbents, the amount is between about 0.5 and 8% by weight of the lower film, and more preferably about 1 to 5%, e. g. 1.5 to 3%.

A most preferred I.R. absorbent is talc (magnesium silicate-$Mg_3Si_4O_{10}(OH)_2$). This is a particularly good absorbent, which is somewhat dull in appearance, substantially non-reflective, can be easily incorporated into the usual plastics for producing pool covers of the present design, and is sufficiently inexpensive to be commercially viable.

It is preferable that the talc is white talc, as opposed to the available slightly green or slightly gray talc, and that the white talc has an average particle size of between about 0.1 and 10 microns. More specifically, it is preferred that the talc have a specific gravity of about 2.6 and 2.9.

With talc of this nature, the lower film will be substantially non-reflective, will absorb infrared radiation readily, but will allow passage of sunlight through the lower film to heat the pool water during the day. Of course, the amount of radiation passing through the cover during the day is much greater than the radiation passing from the pool water through the cover, especially at night. With the talc I.R. absorbent in the amounts described above, the talc will intercept and absorb a substantial amount of the radiation from the pool water to the pool cover, especially at night, and conserve that energy (heat).

It is permissible to put very small amounts of I.R. absorbent in the upper film, but it is preferred that the IR absorbent is only in the lower film. Within the ranges described above, the amount of I.R. absorbent is sufficient to generate substantial heat in the air of the air pockets, i.e., the radiation absorbed by the I.R. absorbent is converted into sensible heat which is transferred by conduction and convection to the air in the air pockets. Thus, the air in the air pockets becomes heated by that absorption. If I.R. is simply passed through the air of the air pockets by either radiation from atmospheric sunlight or by reflection from a reflective layer, as disclosed in the above-noted patents, very little of that radiation will be absorbed by the air of the air pockets. In the present invention, however, the amount of the I.R. absorbent is sufficient to generate substantial heat in the air of the air pockets. Also, that amount is sufficient that the heat generated in the air of the air pockets is capable of substantially heating the pool water next the pool cover, principally by conduction and convection. At the same time, that amount is such that sunlight passing through the cover, since it is not reflected by a reflective layer, is capable of substantially heating the pool water. Accordingly, with the amount of absorbent of the type described above, heat generated in the air of the air pockets and sunlight passing through the cover are capable of substantially heating the pool water.

The present invention, where some infrared is absorbed and other infrared passes (by lack of reflection) through the lower film, is applicable to a wide range of thicknesses of upper and lower films. This invention can be used in connection with thicknesses as little as 1 mm and as great as 40 mm and the same effective function will be obtained The covers may be made with a single upper film and a single lower film or multiple films may form and upper layer and/or a lower layer.

In the specification and following claims, the term "reflectance" and variations thereof are intended to mean that at least 30% of the intercepted radiation is reflected.

The invention will be illustrated with the following Example, where all percents are by weight unless otherwise indicated.

EXAMPLE

Into a blender were placed the following ingredients in the stated percentages by weight: polyethylene, Grade # 1, 62%; Polyethylene, Grade # 2, 19%; master batch including color (tint), UV inhibitor and anti-block, 4.5%; white talc, 2%; and recycle trimmings, 12.5%. After blending the ingredients, the ingredients were transferred to a conventional cast line extruder. The extruder melt was passed through a heated die and then passed to a conventional embossing roll in a conventional staggered method where a produced film is drawn into the embossing roll and another film without talc is laminated thereto. The laminated film was wound onto rolls and subsequently cut and finished into a pool cover product of the invention.

The product of the invention was tested in a comparison with an identical pool cover with the exception that the comparison cover did not have the I.R. absorbent (talc) in either of its layers. The test was run on identical pools on the $30^{th}$ day of September. The pool temperatures for the present cover and the comparison cover at 8 A. M. were 55.1 and 55.2 degrees F., respectively. The weather was sunny with a high temperature of 72 degrees F. At 4 P. M. the pool temperatures were 68.1 and 66.7 degrees F. for the present cover and the comparison cover, respectively, which represents an additional temperature increase for the present cover of 2.5 degrees F. or an increase of 21%.

Thus, the present invention provides a very substantial advance in the art and the invention extends to the breath and spirit of the following claims.

What is claimed is:

1. A heat retaining swimming pool cover (1) for floating disposition on pool water (2) in a swimming pool (3), comprising:

(a) a plastic upper film (5) for facing toward the atmosphere (6);

(b) a plastic lower film (8) for facing toward the pool water (2);

(c) sufficient spaced apart air pockets (10) configured unto the lower film (8) for containing air such that the cover (1) is floatable on the pool water (2);

(d) sealed land areas (11) between the air pockets (10) such that the upper and lower films (5, 8) are sealed to each other; and wherein the lower film (8) contains an effective amount of an I.R. absorbent but the amount is insufficient to prevent atmospheric sunlight (14) from substantially penetrating the lower film (8) and passing into the pool water (2).

2. The pool cover of claim 1, where the upper and lower films are vinyl or olefin or acetate films.

3. The pool cover of claim 2, wherein the films have small amounts of a tint therein, which amount is only sufficient for a cosmetic appearance and which amount does not significantly reduce the transmission of sunlight.

4. The pool cover of claim 1, wherein the I.R. absorbent is a solid, particulate absorbent (15).

5. The pool cover of claim 4, wherein the solid, particulate absorbent is substantially non-reflective.

6. The pool cover of claim 4, wherein the solid, particulate absorbent is in or on the lower film in an amount of between 0.5 to 8% by weight of the lower film.

7. The pool cover of claim 4, wherein the I.R. absorbent is talc.

8. The pool cover of claim 7, wherein the talc is white talc and has an average particle size of between about 0.1 and about 10 microns.

9. The pool cover of claim 8, wherein the talc has a specific gravity of between about 2.6 and about 2.9.

10. The pool cover of claim 1, wherein the I.R. absorbent is only in the lower film.

11. The pool cover of claim 1, wherein the amount of I.R. absorbent is sufficient to generate substantial heat in the air of the air pockets.

12. The pool cover of claim 11, wherein the amount is sufficient that the heat generated in the air of the air pockets is capable of substantially heating pool water next the cover.

13. The pool cover of claim 12, wherein the amount is such that sunlight passing through the cover is capable of substantially heating the pool water.

14. The pool cover of claim 13, wherein the amount is sufficient that heat generated in the air of the air pockets and sunlight passing through the cover are capable of substantially heating the pool water.

15. The pool cover of claim 1, wherein the upper and lower films have thicknesses of between 1 and 40 mm.

* * * * *